US007017617B2

(12) United States Patent
Bassi et al.

(10) Patent No.: US 7,017,617 B2
(45) Date of Patent: Mar. 28, 2006

(54) DEVICE FOR SHED FORMATION AND JACQUARD LOOM COMPRISING SAME

(75) Inventors: Dario Bassi, Chaponnay (FR); Damien Bouchet, Chaponnay (FR); Guillaume Boutte, Aveize (FR)

(73) Assignee: Staubli Lyon, Chassieu (FR)

( * ) Notice: Subject to any disclaimer, the term of this patent is extended or adjusted under 35 U.S.C. 154(b) by 0 days.

(21) Appl. No.: 10/503,815

(22) PCT Filed: Feb. 6, 2003

(86) PCT No.: PCT/FR03/00379

§ 371 (c)(1),
(2), (4) Date: Aug. 6, 2004

(87) PCT Pub. No.: WO03/066945

PCT Pub. Date: Aug. 14, 2003

(65) Prior Publication Data

US 2005/0150563 A1 Jul. 14, 2005

(30) Foreign Application Priority Data

Feb. 7, 2002 (FR) ..... 02 01508

(51) Int. Cl.
*D03C 3/00* (2006.01)

(52) U.S. Cl. ..... 139/59

(58) Field of Classification Search ..... 139/59, 139/65, 68, 55.1, 35, 1 R, 91–96
See application file for complete search history.

(56) References Cited

U.S. PATENT DOCUMENTS

| | | | | |
|---|---|---|---|---|
| 3,835,895 | A * | 9/1974 | Bassi | 139/65 |
| 4,195,671 | A | 4/1980 | Bossut | |
| 4,529,011 | A * | 7/1985 | Magat et al. | 139/65 |
| 5,261,464 | A | 11/1993 | Lorenzo et al. | |

FOREIGN PATENT DOCUMENTS

| | | |
|---|---|---|
| DE | 104340 | 12/1898 |
| EP | 0536092 | 4/1993 |
| FR | 2407284 | 5/1979 |
| FR | 2811687 | 1/2002 |
| GB | 1079692 | 8/1967 |
| GB | 1122703 | 8/1968 |

* cited by examiner

*Primary Examiner*—John J. Calvert
*Assistant Examiner*—Andrew W. Sutton

(57) ABSTRACT

The invention concerns a device comprising rigid or semi-rigid shafts (120) and at least a member (200) provided with orifices (203) for the passage and direct guiding in translation and angular positioning of a shaft in its controlled rocking movements ($F_1$). Said member (200) is mobile, with two degrees of freedom relative to the loom frame, in translation ($F_4$), along a direction globally parallel to the direction (A–A') of the weft yarns, and in rotation ($P_4$), about an axis ($Z_1Z'_1$) globally parallel to the translational direction (A–A') of the shafts. Said member (200) can be positioned ($F_4$, $P_4$) by the warp yarns (103) which pass through the eyelets (127) of the shafts (120) which it guides.

10 Claims, 4 Drawing Sheets

DEVICE FOR SHED FORMATION AND JACQUARD LOOM COMPRISING SAME

The invention relates to a shed forming device for a weaving loom of Jacquard type. The invention also relates to a weaving loom equipped with such a device.

In Jacquard looms, it is known to use boards, called "harness boards" for positioning the harness cords of a loom in a horizontal plane perpendicular to their respective rocking direction. These harness boards are generally fixed with respect to the frame of the loom, with the result that the distribution in space of the harness cords and the shafts, or heddles, associated therewith cannot be easily adapted to the shed to be formed. Such fixed harness boards may also be used, as described in FR-A-2 811 687, to guide semi-rigid shafts controlled in rocking movements by one of their ends. As previously, no adaptation of the distribution of the shafts in space can be envisaged.

As described in FR-A-2 407 284 or JP-A-04 136 228, certain looms may be equipped with small boards mobile with one sole degree of freedom between two positions and pierced with holes for passage of the harness cords of a Jacquard loom. This does not make it possible to guide the shafts efficiently, as the harness cords are capable of being deformed, linearly and in torsion, despite their tension. This system therefore does not allow the positioning of the shafts to be adapted to the desired shed, with good precision.

It is a more particular object of the invention to overcome these drawbacks by proposing a shed forming device making it possible to obtain a high density and a high precision of the implantation of the shafts.

In this spirit, the invention concerns a shed forming device which comprises, inter alia, rigid or semi-rigid shafts and at least one member provided with orifices for the passage and direct guiding in translation of a shaft, or heddle, in its controlled rocking movements, while this member is mobile, with two degrees of freedom relative to the loom frame, in translation, in a direction substantially parallel to the direction of the weft yarns, and in rotation, about an axis substantially parallel to the translational direction of the shafts, and this member can be positioned in translation and in rotation by the warp yarns which pass through the eyelets of the shafts which it guides.

Thanks to the two degrees of freedom of the member provided with orifices for passage and guiding of the shafts, the position of this member may be adjusted in translation and/or in rotation, precisely and continuously, as a function of the article to be produced, while the direct guiding of the shafts by this member ensures their precise positioning. A self-positioning of this member may thus be obtained by the tension of the warp yarns passing through the shafts, these shafts being sufficiently rigid to be able to influence the position of this member. It is therefore possible to dispose the shafts with high density, the latter being positioned correctly and with high precision, in particular thanks to the fact that the shafts interact directly, i.e. are in sliding contact, with the guiding member, this constituting a substantial difference with respect to the devices in which more or less taut harness cords rub on harness tie bars. The shafts have a rigidity sufficient to transmit to the guiding member an effort of positioning, unlike the harness cords.

According to an advantageous aspect of the invention, the orifices for passage and guiding of the shafts are adapted to define the angular positioning of the shafts around their rocking axis. In this way, the eyelets borne by the shafts are correctly positioned with respect to the direction of incidence of the corresponding warp yarns.

According to a particularly advantageous aspect of the invention, the orifices for passage and guiding of the shafts have a non-circular section, while the shafts also have a non-circular section. This aspect of the invention makes it possible to control the angular positioning of the shafts around their central axis by cooperation of shapes between the shafts and the orifices for passage and guiding.

According to other advantageous aspects of the invention, the device incorporates one or more of the following characteristics:

- The orifices for passage and guiding are aligned in a row extending substantially in the direction of harness tie of the loom.
- The member provided with orifices for passage and guiding of the shafts is adapted to rest on at least one rail extending in a direction substantially parallel to the direction of passage of the weft yarns. There may be provided means for locking this member on this rail.
- The member comprises housings adapted each to receive an end of a sheath for guiding an element for transmission of effort to one of the shafts, these housings each being disposed opposite an orifice for passage and guiding of a shaft. Each housing extends in orifices for passage of an element for transmission of effort and of parts of a shaft associated with this element.
- The afore-mentioned member is provided, on at least one lateral face, with an element in relief adapted to cooperate with a corresponding element in relief provided on a lateral face of an adjacent member, with a view to a partial imbrication of these members.

Finally, the invention relates to a weaving loom equipped with a shed forming device as described hereinbefore. This loom is simpler to use and to adjust than the looms of the prior art, particularly when the shed is changed.

The invention will be more readily understood and other advantages thereof will appear more clearly in the light of the following description of two forms of embodiment of a shed forming device and of a loom in accordance with its principle, given solely by way of example and made with reference to the accompanying drawings, in which.

Figure 1:
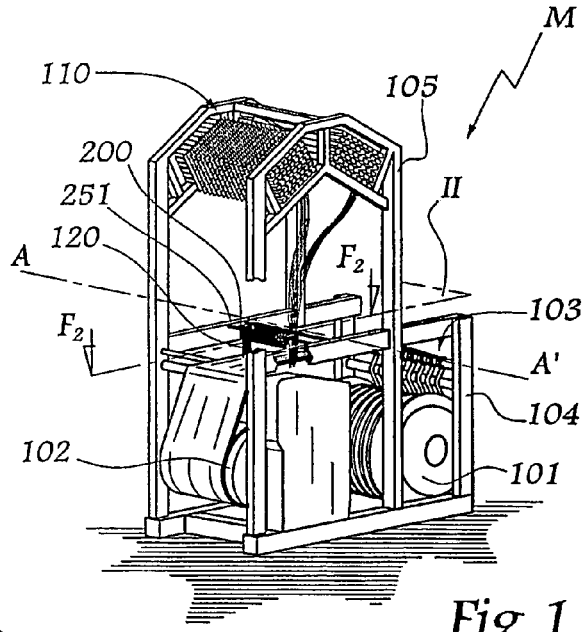
FIG. 1 is a view in perspective of a weaving loom according to the invention.

The loom M shown in FIG. 1 comprises a beam 101 and a reel 102 between which circulate the warp yarns 103 of the loom. A–A' denotes the direction of the picks on the loom M, i.e. the direction of the weft yarns.

The loom M also comprises a chassis 104 supporting the elements 101 and 102 and a system (not shown) for passage of the picks. The chassis 104 extends in a superstructure 105 disposed above the principal part of the loom M and supporting a device 110 for drive and selection of the shafts, or heddles.

Figure 4:
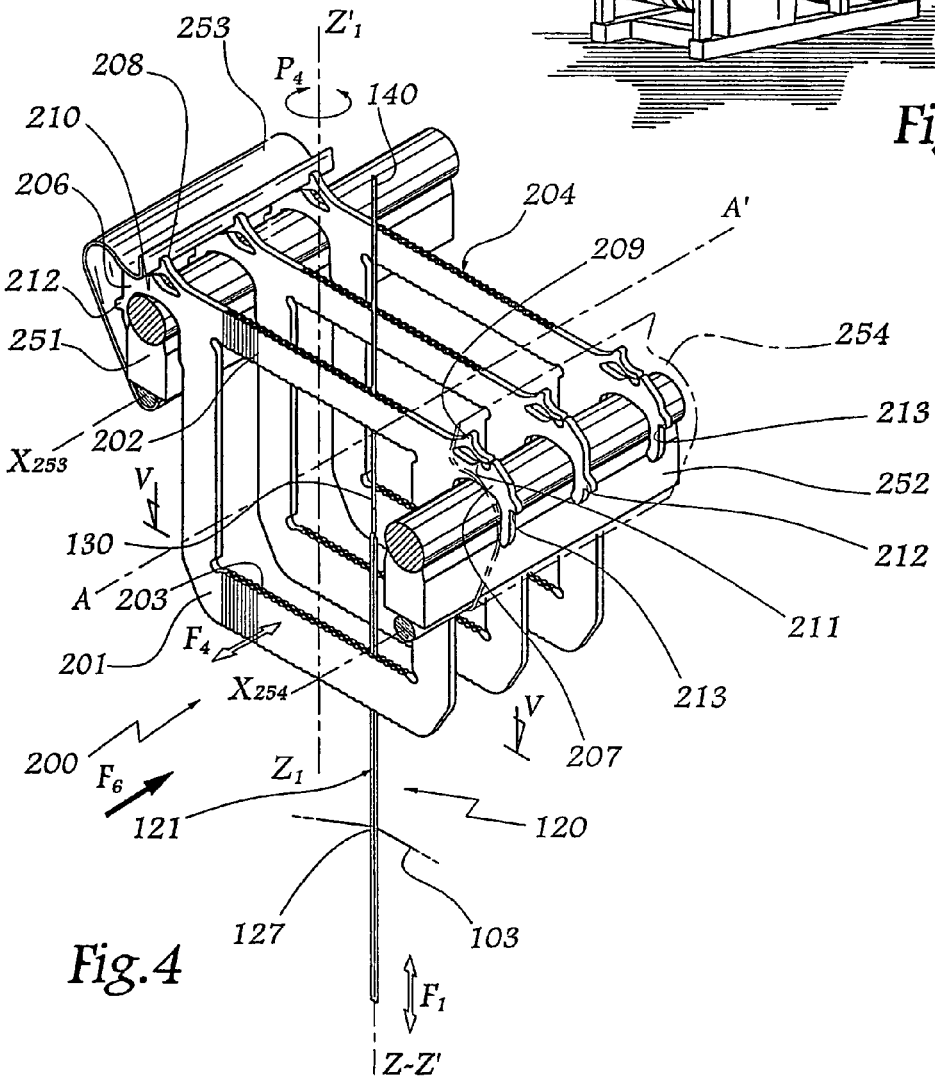
FIG. 4 is a partial view in exploded perspective of a part of the shed forming device used on the loom of FIG. 1.
Figure 5:
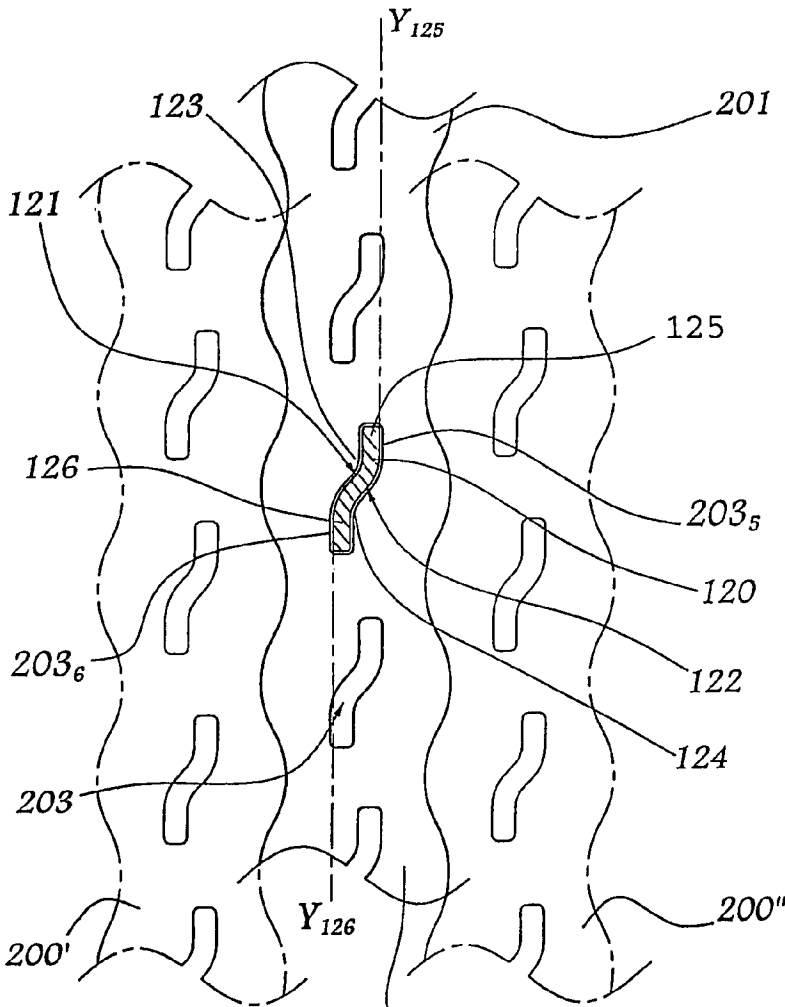
FIG. 5 is a partial section alone line V—V of FIG. 4.

One shaft 120 of this loom is more particularly visible in FIGS. 4 and 5. It is made from a band of metal, for example steel, and comprises, on its lateral faces 121 and 122, two bends 123 and 124 which extend over substantially the whole height of the shaft 120 and define two branches 125 and 126 disposed in two directions $Y_{125}$ and $Y_{126}$ parallel to each other. The shaft 120 therefore has a cross section substantially in the form of a flattened Z. Within the meaning of the present invention, S or Z shapes are equivalent, as they correspond, in fact, to two directions of observation of the same section. This shaft 120 presents a significant rigidity.

The shaft 120 is also provided with an eyelet 127 for passage of a warp yarn 103.

Each shaft 120 is associated with a semi-rigid ring 130 made for example of carbon which controls its vertical oscillations, such oscillations being represented by the double arrow $F_1$ in FIG. 4. The assembly between the shaft 120 and the ring 130 is effected by any appropriate means, preferably reversible. Each ring 130 extends, between the shaft 120 that it entrains and the device 110, inside a sheath 140 making it possible to guide it and to protect it against the outside environment.

Figure 7:
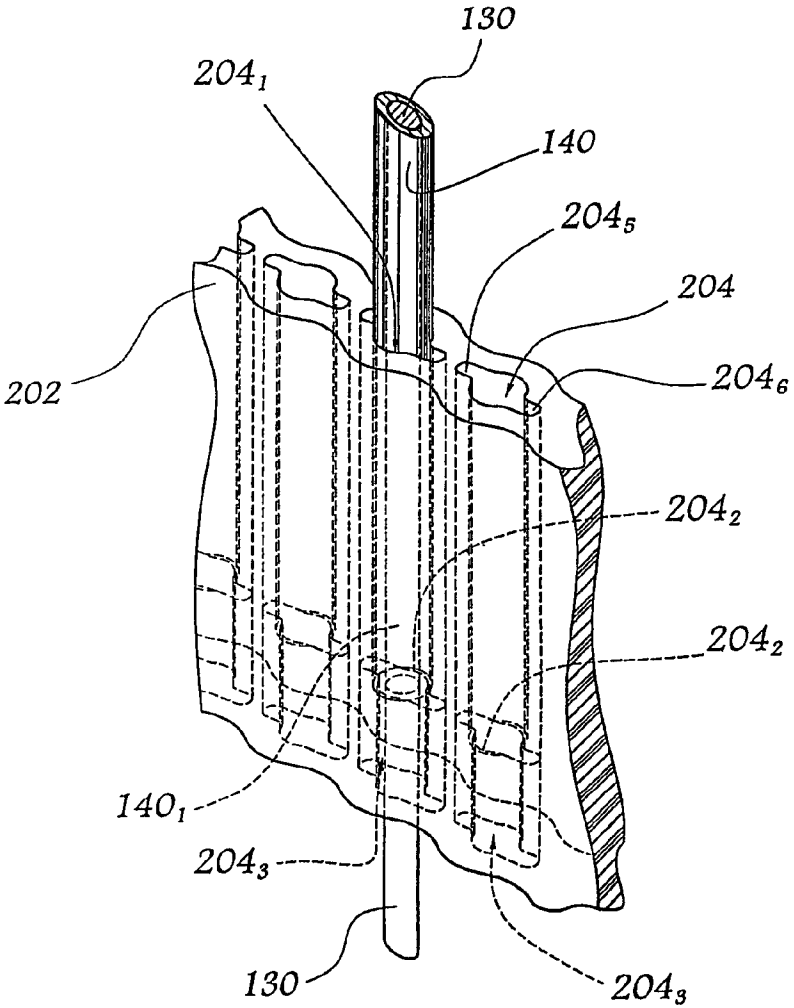
FIG. 7 is a view in perspective of detail VII in FIG. 6.

In FIG. 7, only a part of the sheathes 140 is shown in order to render the drawing clearer. In practice, the number of rings 130 and of sheathes 140 is adapted to the number of shafts 120 of the loom.

A bar 200 makes it possible to guide each shaft 120 in its movement of oscillations and of vertical translations. This bar 200 is made of plastics material and comprises two crosspieces 201 and 202 in which two series of orifices 203 and 204 are made.

One sole shaft is shown in FIGS. 4 to 8 in order to render the drawing clearer. In practice, a large number of shafts may be provided, each bar 200 being able to guide as many shafts 120 as it comprises orifices 203 and 204.

As is more particularly apparent from FIG. 5, each orifice 203 has a shape adapted to the cross section of the shaft 120 that it receives, this allowing it to guide it in its movement of translation 1. More precisely, the orifice 203 has a cross section in the form of a flattened Z and forms two branches $\mathbf{203}_5$ and $\mathbf{203}_6$ in which are engaged the branches 125 and 126 of the cross section of the shaft 120. The angular position of each shaft 120 about its longitudinal axis Z–Z' is imposed by the cooperation of the branches $\mathbf{203}_5$ and 125, on the one hand, $\mathbf{203}_6$ and 126, on the other hand.

Figure 6:
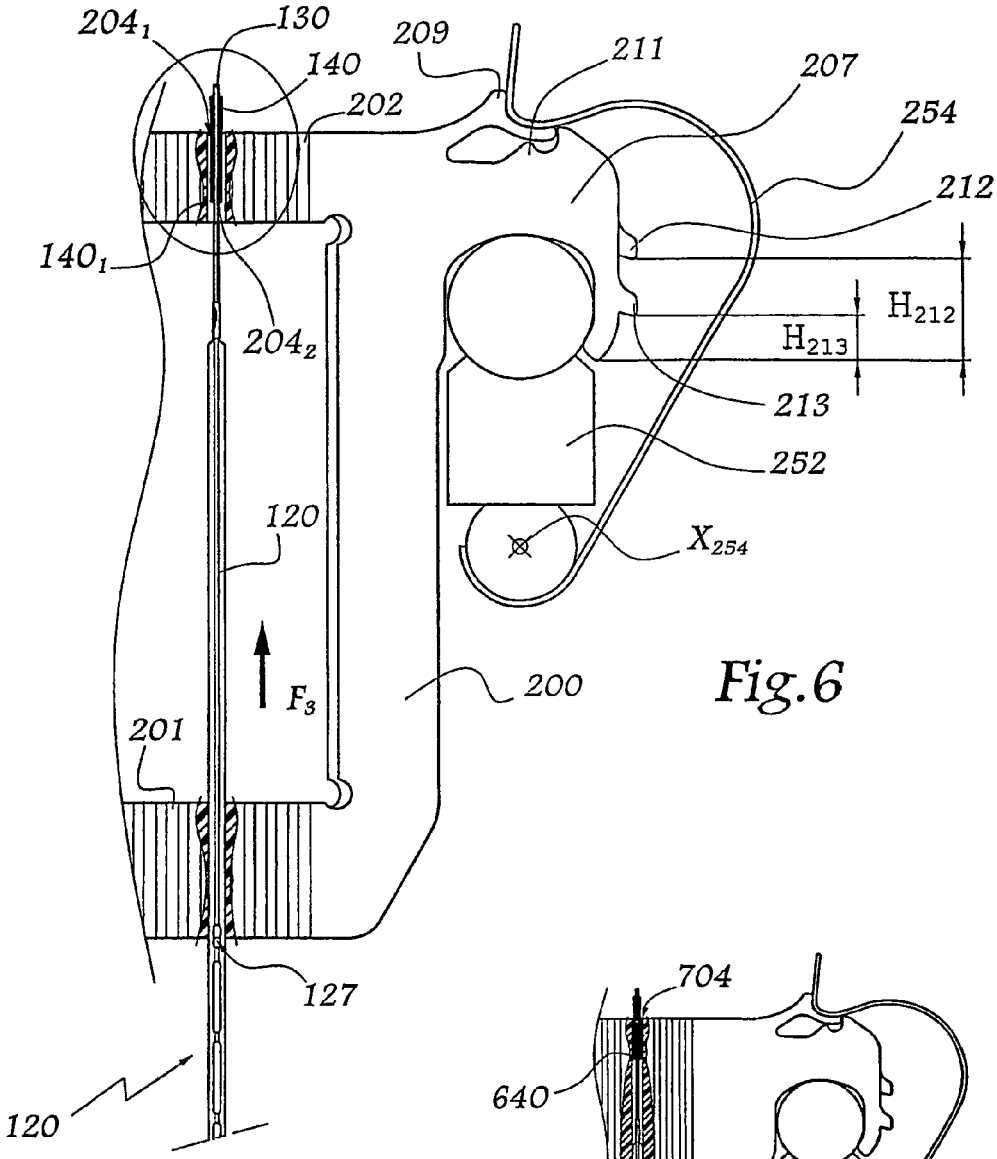
FIG. 6 is a partial view, with parts town away, in the direction of arrow $F_6$ in FIG. 4.

An orifice 204 is more clearly apparent in FIGS. 6 and 7. It comprises an entrance zone $\mathbf{204}_1$ in which the lower end $\mathbf{140}_1$ of a sheath 140 may be introduced. A shoulder $\mathbf{204}_2$ forms a stop to the introduction of the end $\mathbf{140}_1$. Opposite the entrance side of the end $\mathbf{140}_1$, the orifice 204 extends in a conduit $\mathbf{204}_3$ for passage of the ring 130.

The orifice 204 also comprises two branches $\mathbf{204}_5$ and $\mathbf{204}_6$ similar to branches $\mathbf{203}_5$ and $\mathbf{203}_6$ of the orifice 203 and allowing the passage of the branches 125 and 126 through the orifice 204. It is thus possible to withdraw a shaft 120 from the bar 200 by extracting it from the top through the corresponding orifice 204, as represented by arrow $F_3$ in FIG. 6.

The shed forming device of the loom M comprises a plurality of bars 200 of which certain are shown in dashed and dotted lines in FIGS. 4 and 5. These bars rest on two rails 251 and 252 which are supported by the chassis 104 and extend in directions substantially parallel to direction A–A'. The bars 200 and equivalent are each provided with two hooks 206 and 207 allowing them to come into abutment on the rails 251 and 252.

The bar 200 shown in FIGS. 4 to 7 comprises twenty four orifices 203 for passage and guiding of a shaft 120 and twenty four orifices 204 for partially receiving a sheath 140, the orifices 203 and 204 being aligned in two's in a direction parallel to the direction of slide of the shafts 120 which is parallel to their longitudinal axes Z–Z'.

Operation of the shed forming device will now be explained with reference to FIGS. 2 and 3 where three bars of the type of bar 200 have been shown, each with three orifices similar to the orifices 203. Of course, the number of orifices of the bars 200 is not limited and results from a choice of design, particularly concerning the depth of harness tie of the loom. The choice of three orifices for the representation of FIGS. 2 and 3 was dictated by a preoccupation with clarity of the drawings.

Figure 3:
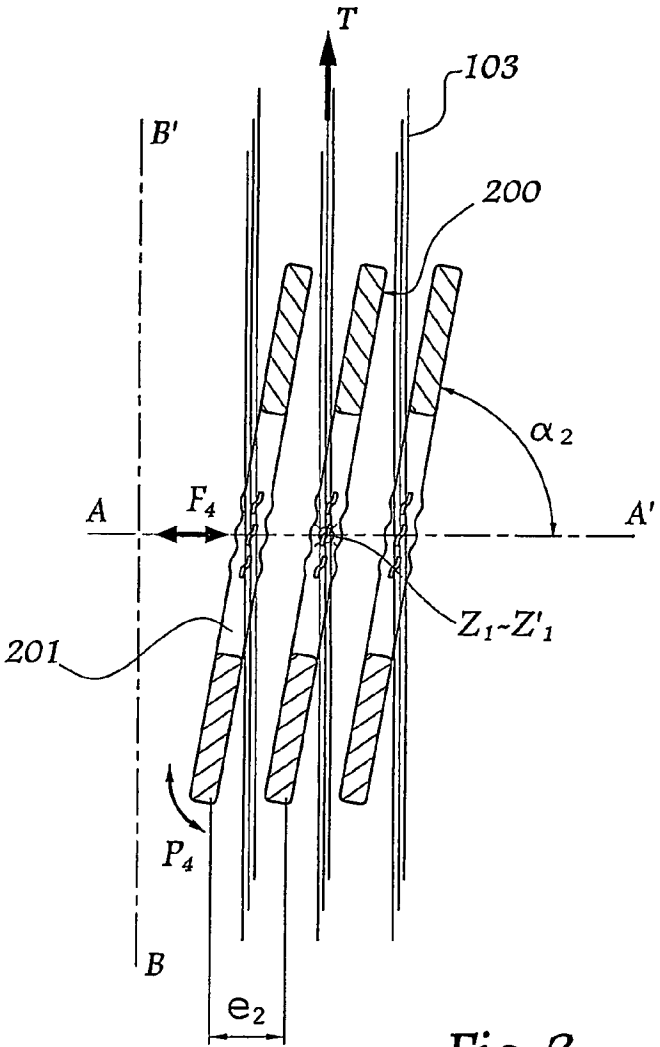
FIG. 3 is a view similar to FIG. 2 in another configuration of use of the loom.
Figure 2:
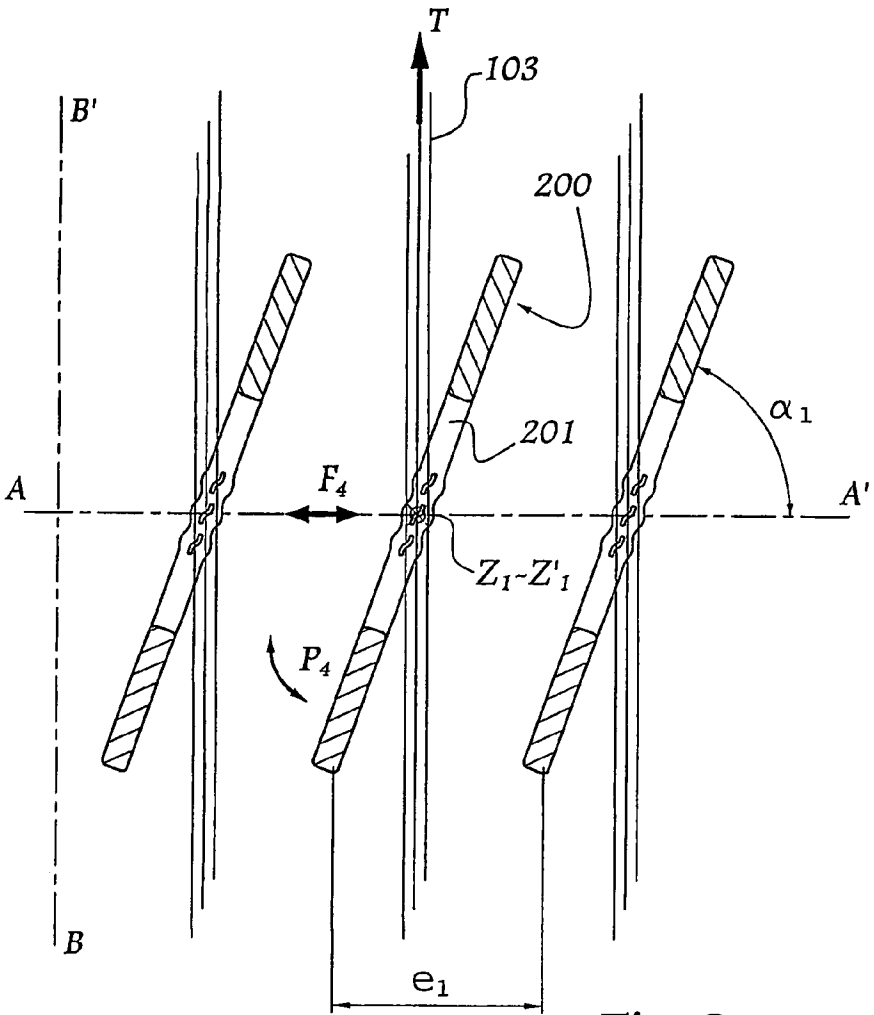
FIG. 2 is a schematic view in plane II and in the direction of arrows $F_2$ of FIG. 1, the number of warp yarns being reduced to nine and the number of bars being reduced to three in order to render the drawing clearer.

As is more particularly apparent from FIGS. 2 and 3, the bars 200 are in abutment on the rails 251 and 252 and may slide parallel to the direction A–A', as represented by the double arrow $F_4$.

The respective dimensions of the tabs 206 and 207 and of the rails 251 and 252 are such that a movement of pivoting of each bar 200 is possible about a central axis $Z_1$–$Z'_1$ parallel to direction Z–Z', this pivoting movement being represented by the double arrow $P_4$.

In this way, the angle of the bars 200 with respect to the direction A–A' may pass from a relatively small value $\alpha_1$, shown in FIG. 2, to a larger value $\alpha_2$ visible in FIG. 3, as a function of the density of the warp yarns 103 and/or of the shafts 120 on the depth of harness tie. Similarly, the spacing between two consecutive bars decreases, from a value $e_1$ to a value $e_2$, upon passage from the configuration of FIG. 2 to that of FIG. 3. Measures are taken to avoid a bar 200 interfering with the warp yarns traversing the shafts guided by an adjacent bar, in particular by limiting the minimum value of the spacing between two consecutive bars.

The tension T of the warp yarns 103 and their orientation, substantially in a direction B–B' perpendicular to the direction A–A', make it possible to position the bars 200 with respect to the rails 251 and 252 both in translation in the direction of arrow $F_4$ and in rotation in the direction of arrow $P_4$.

In this way, each bar 200 may be positioned with two degrees of freedom with respect to the rails 251 and 252, i.e. with respect to frame 104, this allowing a fine and continuous adjustment of the position of the guiding bars 200 and consequently of the shafts 120.

As a comparison of FIGS. 2 and 3 will show, it is possible to dispose the bars 200 with a more or less great density in the direction A–A'. The adjustment of this density is obtained continuously, in that the bars 200 may take any suitable position along the rails 251 and 252. Similarly, the adjustment of the bars 200 in orientation about their respective central axes $Z_1$–$Z'_1$ may be effected continuously.

When a satisfactory position of the bars 200 is obtained, the latter may be immobilized on the rails 251 and 252 thanks to hooks 253 and 254 articulated respectively along axes $X_{253}$ and $X_{254}$ parallel to the principal directions of the rails 251 and 252.

To that end, the bar 200 is provided with two elastically deformable tabs 208 and 209 intended to cooperate respectively with the hooks 253 and 254 for immobilization of the bar. The bar 200 forms, opposite the tab 208, a heel 210 intended to avoid a plastic deformation of the tab 208, while the hook 253 is being placed in position. In the same way, a heel 211 is intended to serve to stop a deformation of the tab 209 when the hook 254 is being placed in position.

Taking into account the geometry of the orifices 203 and 204 and the fact that the bars 200 and equivalent must be able to be juxtaposed with high density, these bars are intended to be more or less imbricated in one another, as is more particularly visible in FIG. 5 where two bars 200' and 200" adjacent the bar 200 are shown in dashed and dotted lines. The bars 200' and 200" are not shown in FIG. 4.

The lateral faces 201*a* and 201*b* of the crosspiece 201 form undulations intended to imbricate with corresponding undulations of the bars 200' and 200". Undulations of the same type are provided on the lateral faces of the crosspiece 202.

Taking into account the fact that two adjacent bars have substantially the same position with respect to the rails 251 and 252 and the fact that it is preferable to use one sole type of bars 200, the bars are designed to be disposed alternately in one direction and in another about their pivot axes $Z_1$–$Z'_1$, the hook 206 of a bar 200 coming into abutment on the rail 251 while the hooks 207 of the two adjacent bars come into abutment on this same rail. This allows the imbrication of the afore-mentioned undulations.

In order to facilitate finding of the orientation of the bars 200 about their respective pivot axes $Z_1$–$Z'_1$, the branches 206 and 207 are respectively provided with two projections 212 and 213 disposed at different heights $h_{212}$ and $h_{213}$ with respect to the lower ends of the hooks 206 and 207.

When a series of bars is correctly positioned on the rails 251 and 252, there are seen, on each side of the assembly thus formed, alternating projections 212 and 213, which makes it possible to check that the bars are indeed disposed alternately in the two directions provided.

The immobilization obtained with the hooks 207, 208, 253 and 254 is reversible. In effect, it is possible to disengage the hooks 253 and 254 in order to release the bars 200 which may in that case be displaced in the direction of arrows $F_4$ and $P_4$. This may take place during a change of article or a maintenance operation. In this second case, the bars adjacent a bar 200 may be spaced apart therefrom, for example with a view to an intervention on a shaft.

Figure 8:
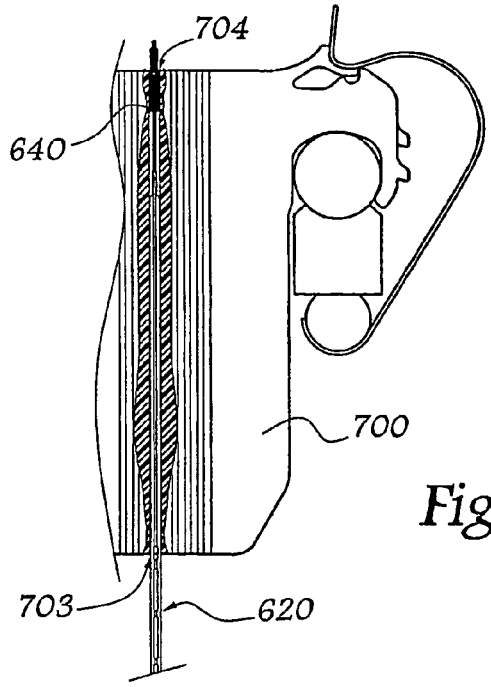
FIG. 8 is a view similar to FIG. 6, on a smaller scale, for a shed forming device in accordance with a second form of embodiment of the invention.

In the second form of embodiment of the invention shown in FIG. 8, elements similar to those of the first embodiment bear identical references increased by 500. The bar 700 of this embodiment differs from the preceding one essentially in that there are not provided two distinct crosspieces, of the type of crosspieces 201 and 202, but the orifices 703 for guiding a shaft 620 and 704 constituting a housing for receiving the end of a sheath 640, are formed by one sole opening made over the height of the bar 700.

According to a variant of the invention (not shown), one sole immobilization lock may be provided for each bar.

The shafts 120 and 620 of the two forms of embodiment described are guided through the orifices 203 and 703 on one sole side of their eyelets 127 and equivalent, in the present case the orifices located above the eyelets.

The invention has been shown with a shaft drive device mounted on the superstructure 105 of the loom M. However, it may also be used in the case of an equivalent device being mounted in the frame 104, between the beam 101 and the reel 102, in which case the shafts 120 and equivalent would be controlled under the lap of warp yarns 103.

What is claimed is:

1. Shed forming device for a weaving loom of Jacquard type, the device comprising rigid or semi-rigid shafts, characterized in that the device further includes at least one member (200; 700) provided with orifices (203; 703) for the passage and direct guiding in translation of a shaft, or heddle, (120; 620) in its controlled rocking movements ($F_1$), in that said member (200; 700) is mobile, with two degrees of freedom relative to the loom frame, in translation ($F_4$), in a direction (A–A') substantially parallel to the direction of the weft yarns, and in rotation ($P_4$), about an axis ($Z_1$–$Z'_1$) substantially parallel to the translational direction ($F_1$) of said shafts (120; 620), and in that said member (200; 700) can be positioned in translation ($F_4$) and in rotation ($P_4$) in the afore-mentioned movements by the warp yarns (103; T) which pass through the eyelets (127) of the shafts (120; 620) guided by said member.

2. Device according to claim 1, characterized in that each shaft (120; 620) is controlled in vertical oscillations ($F_1$) solely by a semi-rigid ring (130) which connects it to a drive device (110).

3. Device according to claim 1, characterized in that said orifices (203; 703) are adapted to define the angular positioning of said shafts (120; 620) about their rocking axis (Z–Z').

4. Device according to claim 3, characterized in that said orifices (203; 703) for passage and guiding have a non-circular section, while the corresponding shafts (120; 620) have a non-circular section.

5. Device according to claim 1, characterized in that said orifices (203; 703) for passage and guiding are aligned in a row extending substantially in the harness tie direction of the loom.

6. Device according to claim 1, characterized in that said member (200; 700) is adapted to rest on at least one rail (251, 252) fixed with respect to the frame and extending in a direction substantially parallel to the direction (A–A') of passage of the weft yarns.

7. Device according to claim 6, characterized in that it comprises means (208, 209, 253, 254) for locking said member (200; 700) on said rail (251, 252).

8. Device according to claim 1, characterized in that said member (200; 700) comprises housings (204; 704) adapted each to receive an end ($140_1$) of a sheath (140) for guiding an element (130) for transmission of effort to one of said shafts (120; 620), said housings each being disposed opposite an orifice (203; 703) for passage and for guiding a shaft, while each housing (204) extends by orifices ($204_3$–$204_6$) for passage of an effort transmission element (130) and of parts (125, 126) of a shaft (120) associated with said element.

9. Device according to claim 1, characterized in that said member (200) is provided, on at least one lateral face (201*a*, 201*b*) with an element in relief adapted to cooperate with a corresponding element in relief provided on a lateral face of an adjacent member (200', 200"), with a view to a partial imbrication of said members.

10. Weaving loom, characterized in that it comprises a shed forming device (120–254; 620–752) according to claim 1.

* * * * *